US007370493B2

(12) United States Patent
Suzuki et al.

(10) Patent No.: US 7,370,493 B2
(45) Date of Patent: May 13, 2008

(54) VAPOR COMPRESSION REFRIGERATING SYSTEMS

(75) Inventors: Kenichi Suzuki, Takasaki (JP); Masato Tsuboi, Isesaki (JP); Yuuichi Matsumoto, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 11/567,505

(22) Filed: Dec. 6, 2006

(65) Prior Publication Data

US 2007/0125121 A1 Jun. 7, 2007

(30) Foreign Application Priority Data

Dec. 6, 2005 (JP) ..... 2005-351750

(51) Int. Cl.
*F25B 41/00* (2006.01)

(52) U.S. Cl. ..... 62/513; 62/498

(58) Field of Classification Search ..... 62/498, 62/513, 527

See application file for complete search history.

(56) References Cited

U.S. PATENT DOCUMENTS

2004/0134225 A1* 7/2004 Sakamoto et al. ..... 62/498

* cited by examiner

*Primary Examiner*—Melvin Jones
(74) *Attorney, Agent, or Firm*—Baker Botts L.L.P.

(57) ABSTRACT

A vapor compression refrigerating system having a compressor, a radiator, a first pressure reducing mechanism for reducing a pressure of refrigerant cooled by the radiator, a refrigerant branching means for dividing refrigerant (m) reduced in pressure by the first pressure-reducing mechanism into portions, a second pressure reducing mechanism for reducing a pressure of one portion of refrigerant (m1), and a third pressure reducing mechanism for reducing a pressure of another portion of refrigerant (m2). One portion and pressure reduced refrigerant (m1') exchanges heat in a cooler with refrigerant present between the first and third pressure reducing mechanisms, and another portion and pressure reduced refrigerant (m2') is evaporated by an evaporator. The evaporated refrigerant (m2") and the refrigerant (m1') having passed through the cooler are mixed by a gas/liquid separator, and the mixed refrigerant is introduced into the compressor. In a vapor compression refrigerating system using carbon dioxide, the degree of refrigerant superheating at a suction side of the compressor may be reduced, and a coefficient of performance of the refrigerating cycle may be increased.

19 Claims, 5 Drawing Sheets

VAPOR COMPRESSION REFRIGERATING SYSTEMS

BACKGROUND OF THE INVENTION

1. Field of the Invention

This application claims the benefit of Japanese Patent Application No. 2005-351750, filed Dec. 6, 2005, which is incorporated herein by reference.

The present invention relates to vapor compression refrigerating systems, and specifically, to vapor compression refrigerating systems using carbon dioxide refrigerant suitable for use in an air conditioning system for vehicles.

2. Description of Related Art

In a case in which carbon dioxide refrigerant, which is a natural-system refrigerant, is used as refrigerant for a vapor compression refrigerating system, a structure is disclosed in Japanese Patent Application No. H07-294033 A, wherein a pressure of refrigerant in a higher pressure-side line is adjusted by controlling a valve opening degree of an expansion device by an external control signal in order to improve an efficiency of a refrigerating cycle. In such a refrigerating system, a higher pressure-side pressure, realizes an optimum coefficient of performance of the refrigerating system, is calculated by referring to a temperature of refrigerant in the higher pressure side and the like, and the valve opening degree of the expansion device is controlled, so that the higher pressure-side pressure is optimized.

Further, as another method for improving an efficiency of a refrigerating system, a structure is disclosed, for example, in Japanese Patent Application No. H11-193967 A, wherein an internal heat exchanger is provided for exchanging heat between refrigerant at an exit side of a radiator and refrigerant at a suction side of a compressor. In such a refrigerating system having an internal heat exchanger, it is possible to suppress increases in higher pressure-side pressure by reducing the specific enthalpy of the refrigerant at the exit to the radiator as compared with a refrigerating system without the internal heat exchanger, thereby improving the coefficient of performance of the refrigerating system.

Thus, in a refrigerating system having an internal heat exchanger, refrigerant at an exit side of a radiator exchanges heat with refrigerant at a suction side of a compressor. Further, when using carbon dioxide refrigerant, although the temperature refrigerant discharged from a compressor is reduced by a radiator, if a temperature of an external fluid (for example, air), which exchanges heat with the refrigerant in the radiator, reaches or exceeds a certain temperature (for example, critical temperature of carbon dioxide), the refrigerant at the exit to the radiator may not condense and may remain at a supercritical condition. If the refrigerant pressure is reduced, and if the refrigerant is evaporated by an evaporator, the refrigerating capacity may be reduced significantly. Therefore, by the heat exchange between the refrigerant at the exit side of the radiator and the refrigerant at the suction side of the compressor, the refrigerating capacity may be increased or maintained, the higher pressure-side pressure may be reduced as compared with that of a refrigerating system having no internal heat exchanger, and the coefficient of performance of the refrigerating cycle may be increased.

In the above-described refrigerating system including an internal heat exchanger, however, because the refrigerant at an exit side of a radiator exchanges heat with the refrigerant at a suction side of a compressor, when the load of the refrigerating system is elevated, the superheating degree of the refrigerant at the suction side of the compressor also is elevated. As a result, the discharge temperature of the compressor also may be elevated to an undesirable level. Thus, it becomes necessary to increase the thermal resistance of the compressor itself in order to protect the compressor. Further, if the superheating degree of refrigerant drawn into the compressor increases, the power required for compressing operation of the compressor may increase. Therefore, in the above-described refrigerant system, the need to increase the thermal resistance of the compressor and the increased power required for compressor operation may be undesirable.

SUMMARY OF THE INVENTION

Accordingly, it is an object of the present invention to provide vapor compression refrigerating systems, in particular, vapor compression refrigerating systems using carbon dioxide refrigerant, which may reduce the degree of superheating of the refrigerant at a suction side of a compressor, and which may increase a coefficient of performance of the refrigerating system.

To achieve the foregoing and other objects, a vapor compression refrigerating system according to the present invention may operate at a supercritical condition, and has a compressor for compressing refrigerant; a radiator for reducing the temperature of refrigerant with an elevated temperature and an elevated pressure due to compression by the compressor, a first pressure-reducing means for reducing a pressure of refrigerant, the temperature of which is reduced by the radiator; a refrigerant branching means for dividing refrigerant (m) reduced in pressure by the first pressure-reducing means into a plurality of portions, a second pressure-reducing means for reducing a pressure of one portion of the refrigerant (m1) divided by the refrigerant branching means; and a third pressure-reducing means for reducing a pressure of another portion of the refrigerant (m2) divided by the refrigerant branching means, wherein the temperature of refrigerant compressed by the compressor is reduced by the radiator, the refrigerant passed through the radiator is reduced in pressure by the first pressure-reducing means. The pressure reduced refrigerant (m) is divided by the refrigerant branching means into portions, one portion of the refrigerant (m1) is reduced in pressure by the second pressure-reducing means. The pressure reduced refrigerant (m1') exchanges heat with refrigerant present between the first pressure-reducing means and the third pressure-reducing means by a cooler. Another portion of the refrigerant (m2) is reduced in pressure by the third pressure-reducing means. The pressure reduced refrigerant (m2') is evaporated by an evaporator, and the evaporated refrigerant (m2") and the refrigerant (m1') having passed through the cooler are mixed by an accumulator a gas/liquid separator provided for separating refrigerant gas and liquid refrigerant, and the mixed refrigerant is introduced into the compressor (i.e., a first vapor compression refrigerating system).

In this vapor compression refrigerating system, a structure may be employed wherein the temperature of refrigerant compressed by the compressor is reduced by the radiator, the pressure of refrigerant passed through the radiator is reduced by the first pressure-reducing means, the pressure reduced refrigerant (m) is divided by the refrigerant branching means into a plurality of portions, one portion of refrigerant (m1) is reduced in pressure by the second pressure-reducing means, and the pressure reduced refrigerant (m1') exchanges heat with refrigerant (m) reduced in pressure by the first pressure-reducing means and before being divided by the refrigerant branching means by the cooler, thereby reducing the temperature of the refrigerant (m) reduced in pressure by the first pressure-reducing means. Another portion of refrigerant (m2) is reduced in pressure by the third pressure-reducing means, the pressure reduced refrigerant (m2') is evaporated by the evaporator, the evaporated refrigerant (m2") and the refrigerant (m1') having passed through the cooler are mixed by the gas/liquid separator (e.g., the accumulator), and the mixed refrigerant is introduced into the compressor. In this embodiment, a structure may be employed wherein the second pressure-reducing means, the third pressure-reducing means, and the refrigerant branching means are assembled integrally.

Further, a structure also may be employed wherein the temperature of refrigerant compressed by the compressor is reduced by the radiator, the refrigerant passed through radiator is reduced in pressure by the first pressure-reducing means, and the pressure reduced refrigerant (m) is divided by the refrigerant branching means into a plurality of portions, one portion of refrigerant (m1) is reduced in pressure by the second pressure-reducing means, and the pressure reduced refrigerant (m1') exchanges heat with another portion of refrigerant (m2) divided by the refrigerant branching means by the cooler, thereby reducing the temperature of refrigerant (m2). The refrigerant (m2) passed through the cooler is reduced in pressure by the third pressure-reducing means, the pressure reduced refrigerant (m2') is evaporated by the evaporator, the evaporated refrigerant (m2") and the refrigerant (m1') having passed through the cooler are mixed by the gas/liquid separator (e.g., the accumulator), and the mixed refrigerant is introduced into the compressor. In this embodiment, a structure may be employed wherein the first pressure-reducing means, the second pressure-reducing means and the refrigerant branching means are assembled integrally.

In this first vapor compression refrigerating system, a structure may be employed wherein the first pressure-reducing means is configured to adjust a degree of pressure reduction, and the degree of pressure reduction is adjusted by a pressure or a temperature, or both, of refrigerant flowing into the first pressure-reducing means. Further, a structure may be employed wherein the second pressure-reducing means is configured to adjust a degree of pressure reduction, and the degree of pressure reduction is adjusted by a pressure or a temperature, or both, of refrigerant flowing into the second pressure-reducing means. Moreover, a structure may be employed wherein the third pressure-reducing means is configured to adjust a degree of pressure reduction, and the degree of pressure reduction is adjusted by a pressure or a temperature, or both of refrigerant flowing into the third pressure-reducing means. Further, a structure may be employed wherein a degree of pressure reduction of the second pressure-reducing means and a degree of pressure reduction of the third pressure-reducing means are adjusted at a same rate.

Further, a structure may be employed wherein an outside air temperature detecting means for detecting a physical value having a correlation with an outside air temperature is provided, and when the physical value having a correlation with an outside air temperature detected by the outside air temperature detecting means is equal to or less than a predetermined value, the second pressure-reducing means is closed. In an embodiment, a structure may be employed wherein an outside air temperature detecting means for detecting a physical value having a correlation with an outside air temperature is provided, and when the physical value having a correlation with an outside air temperature detected by the outside air temperature detecting means is equal to or less than a predetermined value, the refrigerant branching means prevents the flow of refrigerant into the cooler. In another embodiment, a structure may be employed wherein a higher pressure detecting means for detecting a physical value having a correlation with a refrigerant pressure at a higher-pressure side in the refrigerating system from the compressor to the first pressure-reducing means is provided, and when the physical value having a correlation with a refrigerant pressure at the higher-pressure side detected by the higher pressure detecting means is equal to or less than a predetermined value, the second pressure-reducing means is closed. In still another embodiment, a structure may be employed wherein a higher pressure detecting means for detecting a physical value having a correlation with a refrigerant pressure at a high-pressure side in the refrigerating cycle from the compressor to the first pressure-reducing means is provided, and when the physical value having a correlation with a refrigerant pressure at the high-pressure side detected by the high pressure detecting means is equal to or less than a predetermined value, the refrigerant branching means stops directing refrigerant into the cooler.

Further, a vapor compression refrigerating system, according to the present invention, may operate at a supercritical condition and comprises a compressor for compressing refrigerant, a radiator for reducing the temperature of refrigerant with an elevated temperature and an elevated pressure compressed by the compressor, a first pressure-reducing means for reducing a pressure of refrigerant having been passed through the radiator, a second pressure-reducing means for further reducing a pressure of refrigerant (m) reduced in pressure by the first pressure-reducing means, and a refrigerant branching means for dividing the pressure reduced refrigerant. The temperature of refrigerant compressed by the compressor is reduced by the radiator, the refrigerant passed through the radiator is reduced in pressure by the first pressure-reducing means, the pressure reduced refrigerant (m) is reduced further in pressure by the second pressure-reducing means, and the pressure reduced refrigerant (m') is divided by the refrigerant branching means into a plurality of portions, one portion refrigerant (m1) exchanges heat with the refrigerant (m) reduced in pressure by the first pressure-reducing means by a cooler, thereby reducing the temperature of the pressure reduced refrigerant (m). An other portion of refrigerant (m2) is evaporated by an evaporator, the evaporated refrigerant (m2') and the refrigerant (m1') having passed through the cooler are mixed by a gas/liquid separator (e.g, an accumulator) provided for separating gas/liquid of refrigerant, and the mixed refrigerant is introduced into the compressor (i.e., a second vapor compression refrigerating system).

In this second vapor compression refrigerating system, a structure may be employed wherein the second pressure-reducing means and the refrigerant branching means are assembled integrally.

Further, a structure also may be employed wherein the first pressure-reducing means is configured to adjust a degree of pressure reduction, and the degree of pressure reduction is adjusted by a pressure or a temperature, or both, of refrigerant flowing into the first pressure-reducing means. Further, a structure may be employed wherein an outside air temperature detecting means for detecting a physical value having a correlation with an outside air temperature is provided, and when the physical value having a correlation with an outside air temperature detected by the outside air temperature detecting means is equal to or less than a predetermined value, the refrigerant branching means prevents the flow of refrigerant into the cooler. In another embodiment, a structure may be employed wherein a higher pressure detecting means for detecting a physical value having a correlation with a refrigerant pressure at a higher-pressure side in said refrigerating cycle from the compressor to the first pressure-reducing means is provided, and when the physical value having a correlation with a refrigerant pressure at the higher-pressure side detected by the higher pressure detecting means is equal to or less than a predetermined value, the refrigerant branching means prevents the flow of refrigerant into the cooler.

In the first and second vapor compression refrigerating systems according to the present invention, carbon dioxide refrigerant preferably is used. The vapor compression refrigerating systems are suitable for use for air conditioning systems for vehicles.

Thus, in the vapor compression refrigerating system according to the present invention, and particularly as a vapor compression refrigerating system using carbon dioxide refrigerant which is a natural-system refrigerant, the dryness of the refrigerant of the refrigerating system at an entrance of the evaporator may be reduced, and the refrigerating capacity of the evaporator may be increased. Further, the superheating degree of refrigerant at the suction side of the compressor may be reduced as compared with that in the known refrigerating system using an internal heat exchanger for exchanging heat between the suction side of the compressor and the exit side of the radiator. Because the efficiency of the compressor may be improved and the discharge temperature thereof may be lowered, the coefficient of performance of the refrigerating system may be increased.

Further objects, features, and advantages of the present invention will be understood from the following detailed description of preferred embodiments of the present invention with reference to the accompanying figures.

BRIEF DESCRIPTION OF THE DRAWINGS

Embodiments of the invention now are described with reference to the accompanying figures, which are given by way of example only, and are not intended to limit the present invention.

DETAILED DESCRIPTION OF PREFERRED EMBODIMENTS

Figure 1:
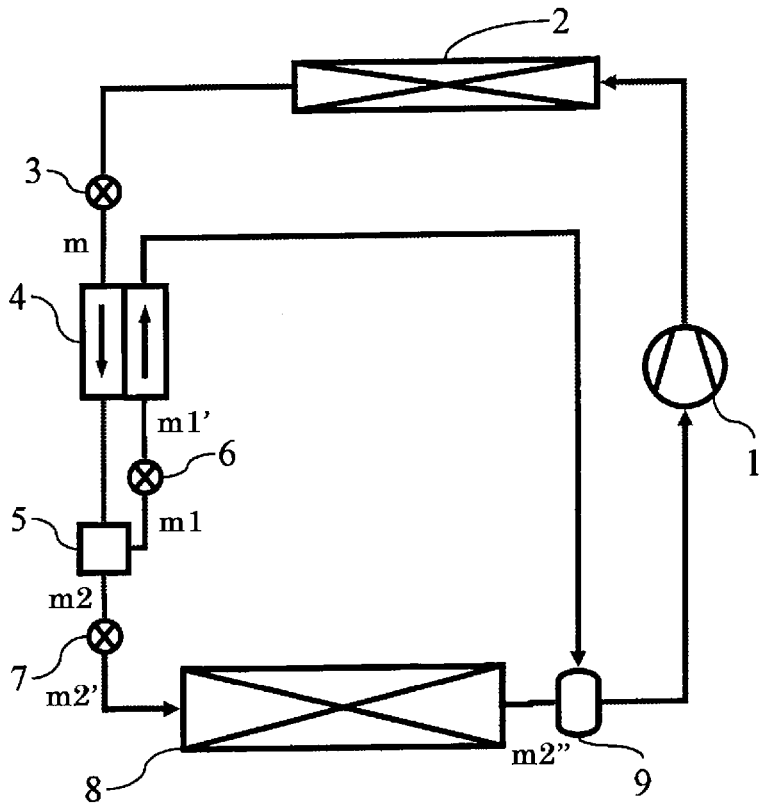
FIG. 1 is a schematic diagram of a vapor compression refrigerating system according to an embodiment of the present invention.

FIG. 1 depicts a main structural part of a vapor compression refrigerating system according to an embodiment of the present invention, using carbon dioxide refrigerant which is natural-system refrigerant. In this refrigerating system, refrigerant compressed by a compressor 1 is introduced into a radiator 2, the refrigerant exchanges heat with an external fluid. The refrigerant passed through radiator 2 is reduced in pressure by a first pressure reducing mechanism 3 provided as a first pressure-reducing means at the exit side of radiator 2. The pressure reduced refrigerant (m) is divided into a plurality of portions by a refrigerant branching mechanism 5 provided as a refrigerant branching means. One portion of refrigerant (m1) is reduced in pressure by a second pressure reducing mechanism 6 provided as a second pressure-reducing means, the pressure reduced refrigerant (m1') exchanges heat with the refrigerant (m) in a cooler 4, and the temperature of refrigerant (m) is reduced before refrigerant (m) is divided. Further, another portion of refrigerant (m2) is divided by refrigerant branching mechanism 5 and is reduced in pressure by a third pressure reducing mechanism 7 provided as a third pressure-reducing means, and the pressure reduced refrigerant (m2') is introduced into an evaporator 8. After refrigerant (m2") flows out from evaporator 8 and after refrigerant (m1') passes through cooler 4, refrigerants (m2" and m1') flow into an accumulator 9 provided as a gas/liquid separator and are mixed therein. Accumulator 9 stores liquid refrigerant, and releases the refrigerant gas components of the received refrigerant. Accumulator 9 also supplies refrigerant gas a part of the refrigerating system connected to compressor 1.

Refrigerant (m1) is diverted by refrigerant branching mechanism 5 and flowing to the side of second pressure reducing mechanism 6 and preferably is controlled to have a volume less than that of refrigerant (m2) which flows to the side of third pressure reducing mechanism 7. For example, the diameter of the tube connected to second pressure reducing mechanism 6 may be less than the diameter of the tube connected to third pressure reducing mechanism 7.

Figure 9:
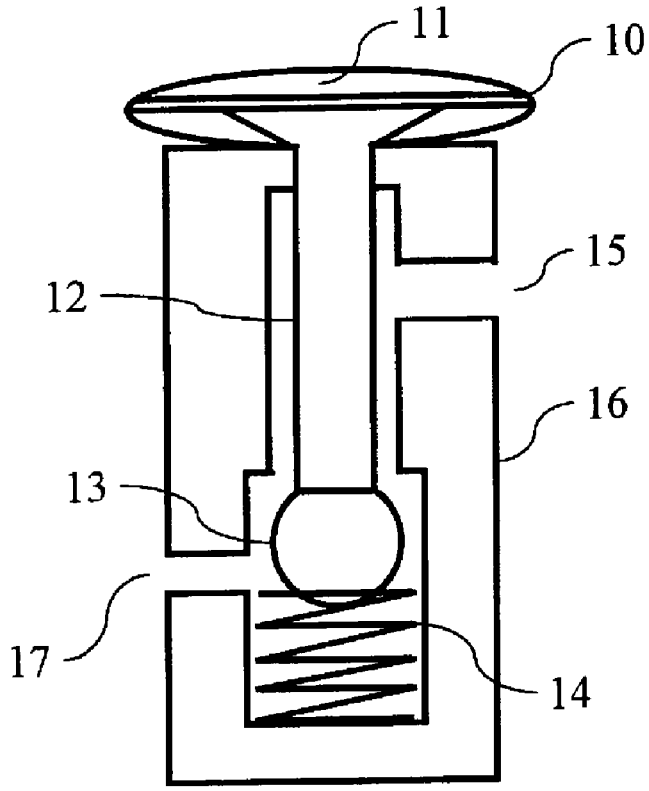
FIG. 9 is a schematic sectional view of a temperature-type pressure reducing device showing an example of a refrigerant pressure reducing mechanism.
Figure 10:
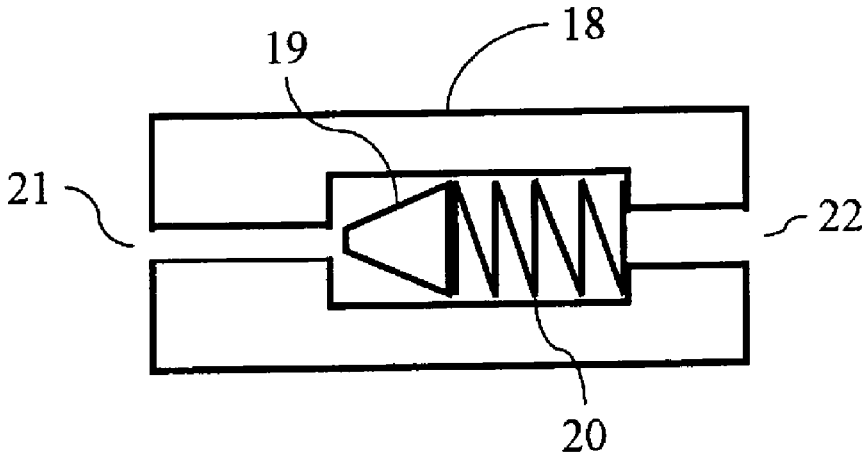
FIG. 10 is a schematic sectional view of a pressure-type pressure reducing device showing an example of a refrigerant pressure reducing mechanism.

Further, second and third pressure reducing mechanisms 6 and 7 and refrigerant branching mechanism 5 may be assembled integrally. In addition, the function of refrigerant branching mechanism 5 may be achieved by changing the flow rate of refrigerant by second pressure reducing mechanism 6. Moreover, second pressure reducing mechanism 6 or third pressure reducing mechanism 7 may be configured to change a degree of pressure reduction or the temperature of the received refrigerant. More concretely, these structures are shown in FIGS. 9 and 10. Moreover, it is preferred that degrees of pressure reduction at second and third pressure reducing mechanisms 6 and 7 are controlled to be equal to each other.

Further, when a physical value having a correlation with an outside air temperature is detected, and when the detected value is equal to or less than a predetermined value, the refrigerant passage may be closed by second pressure reducing mechanism 6 configured to adjust a degree of pressure reduction, or diversion of refrigerant to cooler 4 may be prevented by refrigerant branching mechanism 5. In addition, when a physical value having a correlation with a refrigerant pressure at a higher-pressure side in the refrigerating system is detected, and when the detected value is equal to or less than a predetermined value, the refrigerant passage may be closed by second pressure reducing mechanism 6 configured to adjust a degree of pressure reduction, or diversion of refrigerant to cooler 4 may be prevented by refrigerant branching mechanism 5.

Figure 2:
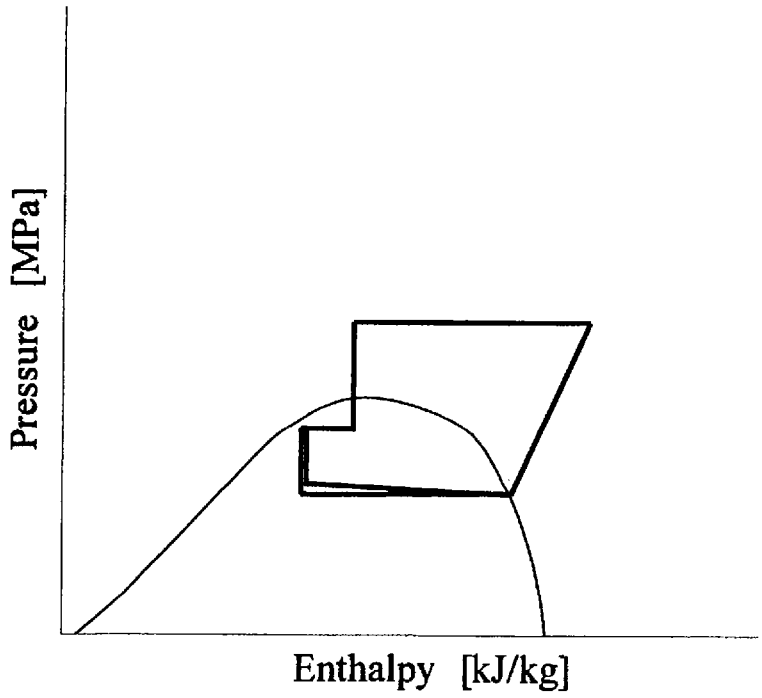
FIG. 2 is a Mollier chart of the vapor compression refrigerating system depicted in FIG. 1.

FIG. 2 shows a Mollier chart of the vapor compression refrigerating system according to the above-described embodiment. As shown in the Mollier chart, the refrigerant may operate in a supercritical region. In FIG. 2, portions of the chart depicted by double lines show operations of divided refrigerants. The same convention is used in the following Mollier charts.

Figure 3:
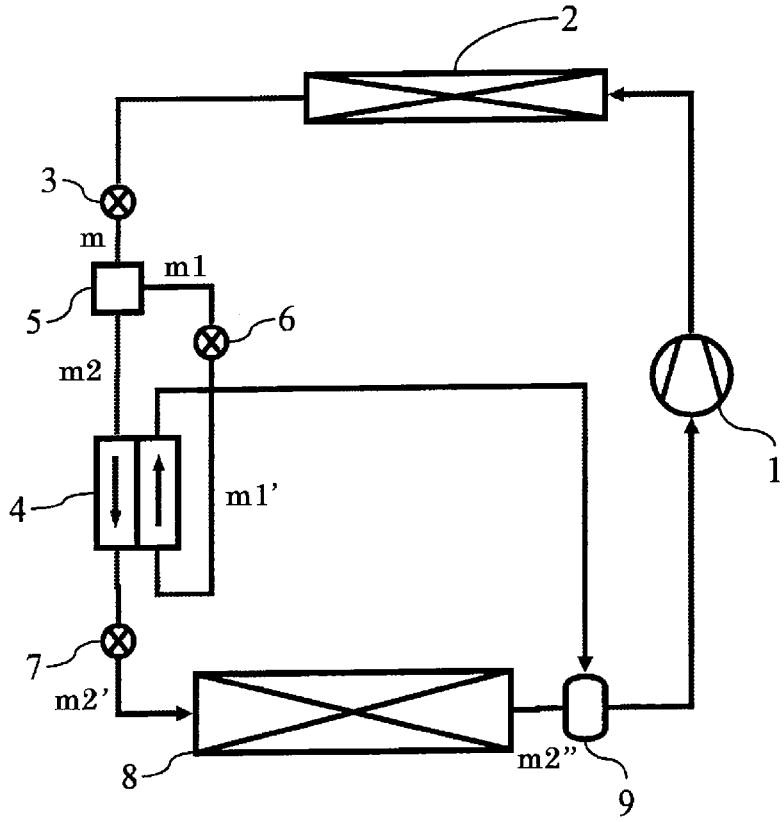
FIG. 3 is a schematic diagram of a vapor compression refrigerating system according to another embodiment of the present invention.

FIG. 3 depicts a main structural part of a vapor compression refrigerating system according to another embodiment of the present invention, using carbon dioxide refrigerant which is natural-system refrigerant. In this refrigerating system, refrigerant compressed by compressor 1 is introduced into radiator 2, the refrigerant exchanges heat with an external fluid. The refrigerant passed through radiator 2 is reduced in pressure by first pressure reducing mechanism 3 provided at the exit side of radiator 2. The pressure reduced refrigerant (m) is divided into portions by refrigerant branching mechanism 5. One portion of refrigerant (m1) is reduced in pressure by second pressure reducing mechanism 6, the pressure reduced refrigerant (m1') exchanges heat with another portion of refrigerant (m2) in cooler 4, and the temperature of the divided refrigerant (m2) is reduced. After passing through cooler 4, the refrigerant (m2) is reduced in pressure by third pressure reducing mechanism 7, and the pressure reduced refrigerant (m2') is introduced into evaporator 8. Refrigerant (m2") flowing out from evaporator 8 and refrigerant (m1') having passed through cooler 4 flow into accumulator 9 provided as a gas/liquid separator and are mixed therein. Similar to in the previous embodiment, accumulator 9 stores liquid refrigerant, and releases the refrigerant gas component of the received refrigerant and supplies the refrigerant gas to a part of the refrigerating system connected to compressor 1.

Refrigerant (m1) is diverted by refrigerant branching mechanism 5, flows to the side of second pressure reducing mechanism 6, and preferably is controlled to have a volume less than that of refrigerant (m2) which flows to the side of cooler 4. For example, the diameter of the tube connected to second pressure reducing mechanism 6 may be less than the diameter of the tube connected to cooler 4. Further, first and second pressure reducing mechanisms 3 and 6 and refrigerant branching mechanism 5 may be assembled integrally. In addition, the function of refrigerant branching mechanism 5 may be achieved by changing the flow rate of refrigerant by second pressure reducing mechanism 6. Moreover, second pressure reducing mechanism 6 or third pressure reducing mechanism 7 may be configured to change a degree of pressure reduction by pressure or temperature, or both, of the received refrigerant. Examples of these structures are shown in FIGS. 9 and 10. Moreover, it is preferred that degrees of pressure reduction at second and third pressure reducing mechanisms 6 and 7 are controlled to be equal to each other.

Further, when a physical value having a correlation with an outside air temperature is detected, and when the detected value is equal to or less than a predetermined value, the refrigerant passage may be closed by second pressure reducing mechanism 6 which is configured to adjust a degree of pressure reduction, or diversion of refrigerant to cooler 4 may be prevented by refrigerant branching mechanism 5. In addition, when a physical value having a correlation with a refrigerant pressure at a higher-pressure side in the refrigerating cycle is detected, and when the detected value is equal to or less than a predetermined value, the refrigerant passage may be closed by second pressure reducing mechanism 6 which is configured to adjust a degree of pressure reduction, or diversion of refrigerant to cooler 4 may be prevented by refrigerant branching mechanism 5.

Figure 4:
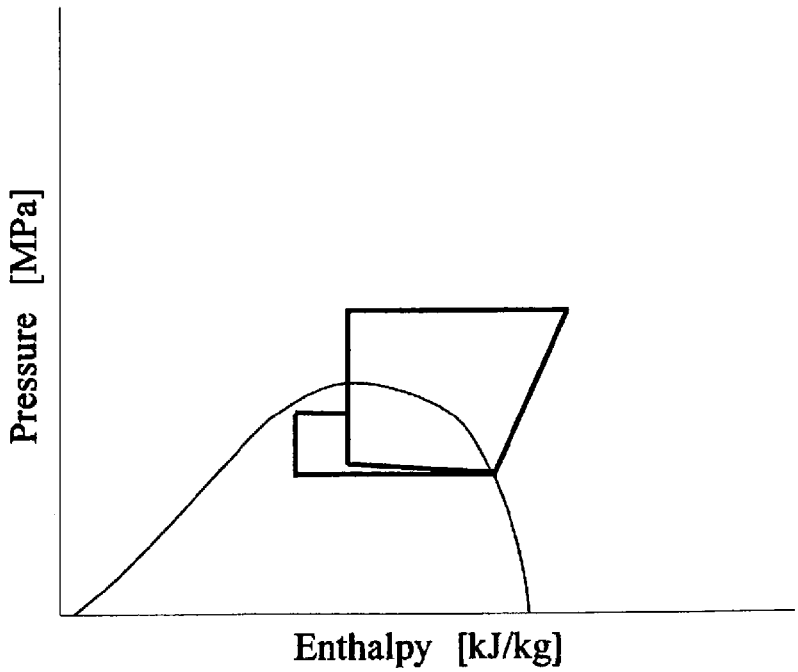
FIG. 4 is a Mollier chart of the vapor compression refrigerating system depicted in FIG. 3.

FIG. 4 shows a Mollier chart of the vapor compression refrigerating system according to the above-described embodiment. As shown in the Mollier chart, the refrigerant may operate in a supercritical region.

Figure 5:
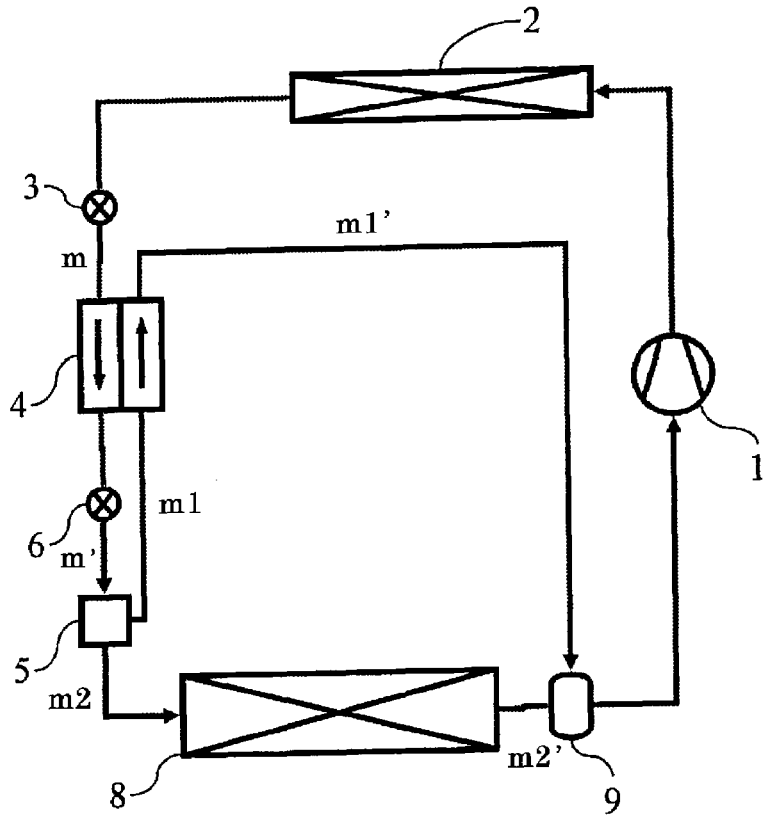
FIG. 5 is a schematic diagram of a vapor compression refrigerating system according to still another embodiment of the present invention.

FIG. 5 depicts a main structural part of a vapor compression refrigerating system according to still another embodiment of the present invention, using carbon dioxide refrigerant which is natural-system refrigerant. In this refrigerating system, refrigerant compressed by compressor 1 is introduced into radiator 2, the refrigerant exchanges heat with an external fluid. The refrigerant passed through radiator 2 is reduced in pressure by first pressure reducing mechanism 3 provided at the exit side of radiator 2. The pressure reduced refrigerant (m) passes through cooler 4, and is reduced further in pressure by second pressure reducing mechanism 6. The pressure reduced refrigerant (m') is divided into portions by refrigerant branching mechanism 5. One portion of refrigerant (m1) exchanges heat in cooler 4 with refrigerant (m) is reduced in pressure by first pressure reducing mechanism 3, by cooler 4, and the refrigerant (m) reduced in pressure by first pressure reducing mechanism 3 is reduced. Another portion of refrigerant (m2) is introduced into evaporator 8. Refrigerant (m2') flowing from evaporator 8 and refrigerant (m1') passed through cooler 4 flow into accumulator 9 provided as a gas/liquid separator and are mixed therein. As described above, accumulator 9 stores liquid refrigerant, and releases the refrigerant gas component of the received refrigerant and supplies the refrigerant gas into a part of the refrigerating system connected to compressor 1.

Refrigerant (m1) is diverted by refrigerant branching mechanism 5, flows to the side of cooler 4, and preferably is controlled to have a volume less than that of refrigerant (m2) which flows to the side of evaporator 8. For example, the diameter of the tube connected to cooler 4 may be less than the diameter of the tube connected to evaporator 8. In addition, second pressure reducing mechanism 6 and refrigerant branching mechanism 5 may be assembled integrally. Moreover, first pressure reducing mechanism 3 or second pressure reducing mechanism 6 may be configured to change a degree of pressure reduction by pressure or temperature, or both, of the received refrigerant. Examples of these structures are shown in FIGS. 9 and 10. Further, when a physical value having a correlation with an outside air temperature is detected, and when the detected value is equal to or less than a predetermined value, diversion of refrigerant to cooler 4 may be prevented by refrigerant branching mechanism 5. Still further, when a physical value having a correlation with a refrigerant pressure at a higher-pressure side in the refrigerating cycle is detected, and when the detected value is equal to or less than a predetermined value, diversion of refrigerant to cooler 4 may be prevented by refrigerant branching mechanism 5.

Figure 6:
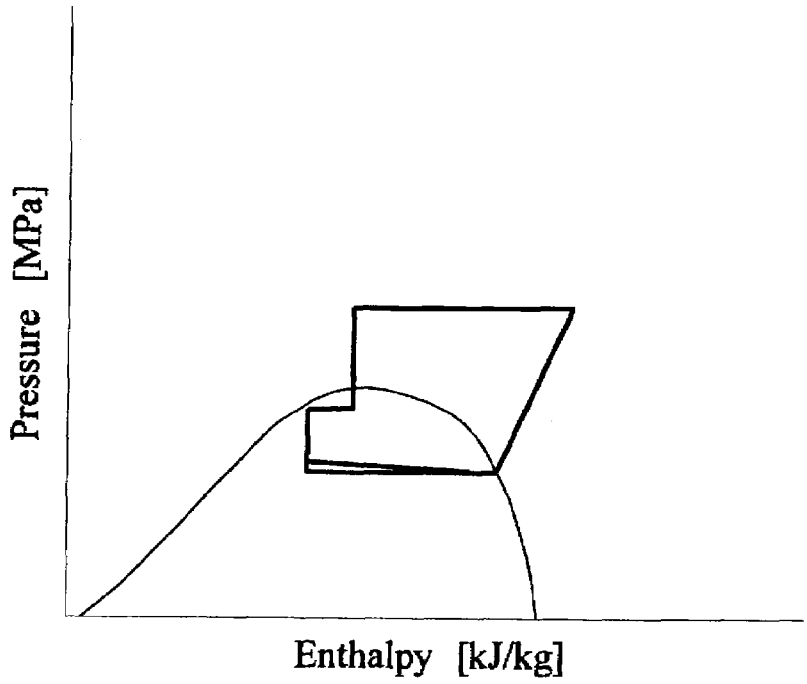
FIG. 6 is a Mollier chart of the vapor compression refrigerating system depicted in FIG. 5.

FIG. 6 shows a Mollier chart of the vapor compression refrigerating system according to the above-described embodiment. As shown in the Mollier chart, the refrigerant may operate in a supercritical region.

Figure 7:
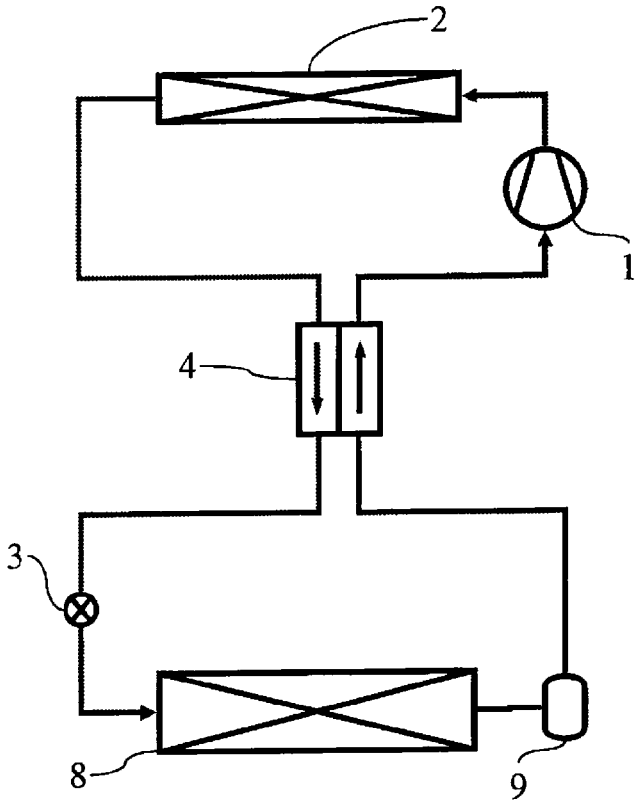
FIG. 7 is a schematic diagram of a known vapor compression refrigerating system.

For comparison, FIG. 7 depicts a main structural part of a known vapor compression refrigerating system, using carbon dioxide refrigerant which is natural-system refrigerant. In this refrigerating system, refrigerant compressed by compressor 1 is introduced into radiator 2, and the refrigerant exchanges heat with an external fluid. The refrigerant passed through radiator 2 is introduced into internal heat exchanger 4. Refrigerant flowing from internal heat exchanger 4 is reduced in pressure by first pressure reducing mechanism 3, and the pressure reduced refrigerant is introduced into evaporator 8. Refrigerant flowing from evaporator 8 flows into accumulator 9 provided as a gas/liquid separator. Refrigerant flowing from accumulator 9 is introduced into internal heat exchanger 4, and refrigerant flowing from internal heat exchanger 4 is introduced into compressor 1. Accumulator 9 stores liquid refrigerant, and releases the refrigerant gas component of the received refrigerant and supplies the refrigerant gas to a part of the refrigerating system connected to compressor 1. Moreover, refrigerant flowing from radiator 2 and refrigerant flowing from accumulator 9 exchange heat with each other in internal heat exchanger 4.

Figure 8:
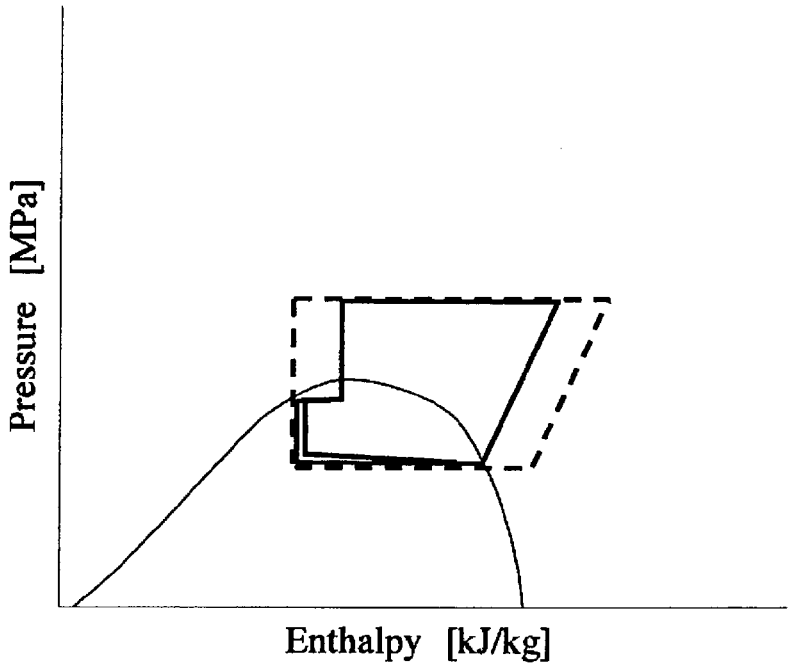
FIG. 8 is a Mollier chart of the vapor compression refrigerating system depicted in FIG. 7.

FIG. 8 shows a Mollier chart (dotted line) of the above-described known vapor compression refrigerating system and the afore-mentioned Mollier chart (solid line) of the vapor compression refrigerating system according to the embodiment of FIG. 1, together.

FIG. 9 shows an example of a refrigerant pressure reducing mechanism in the respective embodiments, and depicts a temperature-type pressure reducing device 16. In temperature-type pressure reducing device 16, a temperature of refrigerant flowing from a refrigerant inlet 15 into the pressure reducing mechanism is detected by a temperature sensing part 12 comprising a diaphragm 10 charged with refrigerant 11, such as carbon dioxide. When the pressure of refrigerant 11 charged in temperature sensing part 12 varies, a valve body 13, such as a needle valve, is operated, and the degree of pressure reduction is adjusted by the variation of the opening degree of the valve. The pressure reduced refrigerant flows from a refrigerant outlet 17.

FIG. 10 shows another example of a refrigerant pressure reducing mechanism in the respective embodiments, and depicts a pressure-type pressure reducing device 18. In pressure-type pressure reducing device 18, a valve body 19, such as a needle valve, operates against a force of a spring 20 by a pressure of refrigerant flowing from a refrigerant inlet 21 into the pressure reducing mechanism. The opening degree of the valve is changed, thereby adjusting the degree of pressure reduction. The pressure reduced refrigerant flows from a refrigerant outlet 22.

In the above-described vapor compression refrigerating systems according to the embodiments of FIGS. 1 and 5, in vapor compression refrigerating systems using carbon dioxide which is natural-system refrigerant, particularly as shown in FIG. 8 by comparison with the known system, the dryness of refrigerant at the entrance of the evaporator in the refrigerating system may be reduced, and the refrigerating ability of the evaporator may be increased. Further, the superheating degree at the suction side of the compressor may be reduced as compared with that in the known system using an internal heat exchanger for heat exchange between the suction side of the compressor and the exit side of the radiator. A difference between the solid line and the dotted line at the right end portion in the Mollier chart depicted in FIG. 8. Because the efficiency of the compressor may be increased and the discharge temperature may be reduced, the efficiency of the vapor compression refrigerating system may be significantly increased.

The vapor compression refrigerating system according to the present invention is suitable, in particular, for a refrigerating system using carbon dioxide which is a natural-system refrigerant, and especially suitable as a refrigerating system used for an air conditioning system for vehicles.

Although embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A vapor compression refrigerating system configured to operate at a supercritical condition, comprising:

a compressor for compressing a refrigerant;

a radiator for reducing a temperature of refrigerant with an elevated temperature and an elevated pressure after the refrigerant passes through the compressor;

a first pressure-reducing means for reducing a pressure of refrigerant after the refrigerant passes through the radiator;

a refrigerant branching means for dividing refrigerant into a plurality of portions after the refrigerant is reduced in pressure by the first pressure-reducing means;

a second pressure-reducing means for reducing a pressure of a first portion of the refrigerant divided by the refrigerant branching means; and a third pressure-reducing means for reducing a pressure of a second portion of the refrigerant divided by the refrigerant branching means;

a cooler, wherein after the first portion of the refrigerant passes through the second pressure-reducing means, the first portion of the refrigerant exchanges heat with the refrigerant flowing between the first pressure-reducing means and the third pressure-reducing means;

an evaporator, wherein after the second portion of the refrigerant passes through the third pressure-reducing means, the second portion of the refrigerant is evaporated; and a gas/liquid separator, in which the evaporated refrigerant and the first portion of the refrigerant are mixed and a refrigerant gas component is separated from a liquid refrigerant component of the mixed refrigerant and from which the mixed refrigerant flows into the compressor.

2. The vapor compression refrigerating system of claim 1, wherein the second pressure-reducing means, the third pressure-reducing means and the refrigerant branching means are formed integrally.

3. The vapor compression refrigerating system of claim 1, wherein the first pressure-reducing means is configured to adjust a degree of pressure reduction, and the degree of pressure reduction is adjusted by a pressure or a temperature, or both, of refrigerant flowing into the first pressure-reducing means.

4. The vapor compression refrigerating system of claim 1, wherein the second pressure-reducing means is configured to adjust a degree of pressure reduction, and the degree of pressure reduction is adjusted by a pressure or a temperature, or both, of refrigerant flowing into the second pressure-reducing means.

5. The vapor compression refrigerating system of claim 1, wherein the third pressure-reducing means is configured to adjust a degree of pressure reduction, and the degree of pressure reduction is adjusted by a pressure or a temperature, or both, of refrigerant flowing into the third pressure-reducing means.

6. The vapor compression refrigerating system of claim 1, wherein a degree of pressure reduction of the second pressure-reducing means and a degree of pressure reduction of the third pressure-reducing means are changed at a same rate.

7. The vapor compression refrigerating system of claim 1, further comprising an outside air temperature detecting means for detecting a physical value having a correlation with an outside air temperature, and when the physical value having a correlation with an outside air temperature detected by the outside air temperature detecting means is equal to or less than a predetermined value, the second pressure-reducing means is closed.

8. The vapor compression refrigerating system of claim 1, further comprising an outside air temperature detecting means for detecting a physical value having a correlation with an outside air temperature, and when the physical value having a correlation with an outside air temperature detected by the outside air temperature detecting means is equal to or less than a predetermined value, the refrigerant branching means prevents refrigerant from flowing into the cooler.

9. The vapor compression refrigerating system of claim 1, further comprising a higher pressure detecting means for detecting a physical value having a correlation with a refrigerant pressure at a higher-pressure side in the refrigerating cycle from the compressor to the first pressure-reducing means, and when the physical value having a correlation with a refrigerant pressure at the higher-pressure side detected by the higher pressure detecting means is equal to or less than a predetermined value, the second pressure-reducing means is closed.

10. The vapor compression refrigerating system of claim 1, further comprising a higher pressure detecting means for detecting a physical value having a correlation with a refrigerant pressure at a higher-pressure side in the refrigerating cycle from the compressor to the first pressure-reducing means, and when the physical value having a correlation with a refrigerant pressure at the higher-pressure side detected by the higher pressure detecting means is equal to or less than a predetermined value, the refrigerant branching means prevents refrigerant from flowing into the cooler.

11. The vapor compression refrigerating system of claim 1, wherein the refrigerant is carbon dioxide.

12. An air conditioning system for a vehicle comprising the vapor compression refrigerating system of claim 1.

13. A vapor compression refrigerating system configured to operate at a supercritical condition, comprising:

a compressor for compressing a refrigerant;

a radiator for reducing the temperature of refrigerant with an elevated temperature and an elevated pressure compressed by the compressor;

a first pressure-reducing means for reducing a pressure of refrigerant passed through the radiator;

a second pressure-reducing means for further reducing a pressure of the refrigerant reduced in pressure by the first pressure-reducing means;

a refrigerant branching means for dividing the pressure reduced refrigerant, in which the refrigerant is divided into a plurality of portions;

a cooler, in which a first portion of the refrigerant exchanges heat with the refrigerant reduced in pressure by the first pressure-reducing means, thereby reducing the temperature of the pressure reduced refrigerant;

an evaporator, in which a second portion of the refrigerant is evaporated; and a gas/liquid separator, in which the evaporated refrigerant and the refrigerant having passed through the cooler are mixed to separate a refrigerant gas component from a liquid refrigerant component of the mixed refrigerant, and the mixed refrigerant flows into the compressor.

14. The vapor compression refrigerating system of claim 13, wherein the second pressure-reducing means and the refrigerant branching means are formed integrally.

15. The vapor compression refrigerating system of claim 13, wherein the first pressure-reducing means is configured to adjust a degree of pressure reduction, and the degree of pressure reduction is adjusted by a pressure or a temperature, or both, of refrigerant flowing into the first pressure-reducing means.

16. The vapor compression refrigerating system of claim 13, further comprising an outside air temperature detecting means for detecting a physical value having a correlation with an outside air temperature, and when the physical value having a correlation with an outside air temperature detected by the outside air temperature detecting means is equal to or less than a predetermined value, the refrigerant branching means prevents refrigerant from flowing into the cooler.

17. The vapor compression refrigerating system of claim 13, further comprising a higher pressure detecting means for detecting a physical value having a correlation with a refrigerant pressure at a higher-pressure side in the refrigerating cycle from the compressor to the first pressure-reducing means, and when the physical value having a correlation with a refrigerant pressure at the higher-pressure side detected by the higher pressure detecting means is equal to or less than a predetermined value, the refrigerant branching means prevents refrigerant from flowing into the cooler.

18. The vapor compression refrigerating system of claim 13, wherein the refrigerant is carbon dioxide.

19. An air conditioning system for a vehicle comprising the vapor compression refrigerating cycle of claim 13.

* * * * *